US005178552A

United States Patent [19]

Jinno et al.

[11] Patent Number: 5,178,552

[45] Date of Patent: Jan. 12, 1993

[54] CONNECTOR

[75] Inventors: Keishi Jinno; Masanori Tsuji; Tamio Watanabe, all of Shizuoka, Japan

[73] Assignee: Yazaki Corporation, Tokyo, Japan

[21] Appl. No.: 744,740

[22] Filed: Aug. 14, 1991

[30] Foreign Application Priority Data

Aug. 28, 1990 [JP] Japan ..... 2-89204[U]

[51] Int. Cl.[5] ..... H01R 13/44

[52] U.S. Cl. ..... 439/140; 439/159; 439/345

[58] Field of Search ..... 439/345-357, 439/135, 136, 140, 141, 159

[56] References Cited

U.S. PATENT DOCUMENTS

| | | | |
|---|---|---|---|
| 2,396,901 | 3/1946 | Tiffany | 439/140 |
| 4,109,989 | 8/1978 | Snyder, Jr. et al. | 439/140 |
| 4,820,176 | 4/1989 | Niikura | 439/159 X |

FOREIGN PATENT DOCUMENTS

| | | |
|---|---|---|
| 0344850 | 12/1989 | European Pat. Off. . |
| 61-99381 | 6/1986 | Japan . |
| 657458 | 9/1951 | United Kingdom . |
| 704204 | 2/1954 | United Kingdom . |
| 1100005 | 1/1968 | United Kingdom . |
| 1154034 | 6/1969 | United Kingdom . |
| 1286078 | 8/1972 | United Kingdom . |
| 2050074 | 12/1980 | United Kingdom . |

*Primary Examiner*—Larry I. Schwartz
*Assistant Examiner*—Khiem Nguyen
*Attorney, Agent, or Firm*—Sughrue, Mion, Zinn, Macpeak & Seas

[57] ABSTRACT

A connector comprises, a first connector housing having first metal terminals, a second connector housing having second metal terminals engaged with the first metal terminals provided with the first connector housing, and a locking device for engaging the first connector housing with the second connector housing. The lock device includes a spring receiving device, slidably disposed in the first connector housing, for receiving a repulsive force acting between the first and second connector housings through the spring receiving device, and a spring device, for applying the repulsive force to the first and second connector housings through the spring receiving member, disposed between the first connector housing and the spring receiving device.

5 Claims, 4 Drawing Sheets

CONNECTOR

BACKGROUND OF THE INVENTION

This invention relates to a connector used for connection of wire harnesses in motor vehicles.

FIG. 6 shows an example of a conventional connector of this type. In FIG. 6, reference character a designates a female connector housing; and b, a male connector housing. Metal terminals c and d are built in the female connector housing and the male connector housing b, respectively. The female connector housing a has a flexible locking arm e, which is engaged with a locking portion f of the male connector housing b when the male connector housing b is connected to the female connector housing a.

A compression spring g is provided between the female connector housing a and the male connector housing b, acting to move them away from each other.

When the male connector housing b is connected to the female connector housing a, the spring g is compressed. If the locking arm e is not completely engaged with the locking portion f, the force of repulsion of the spring g thus compressed acts to move the housings a and b away from each other, thus preventing the incomplete joint of the housings as shown in Japanese Utility Model Unexamined Publication No. 99381/1986.

FIG. 7 shows the female connector housing a and the male connector housing b which have been completely engaged with each other, with the locking arm e engaged with the locking portion f.

The above-described conventional connector suffers from the following difficulty: That is, when the male and female connector housings b and a are completely engaged with each other, the force of repulsion of the compression spring g acts on the two housings a and b at all times, thus obstructing the stable contact of the metal terminals c and d.

SUMMARY OF THE INVENTION

In view of the foregoing, an object of this invention is to provide a connector comprising a pair of connector housings and a spring for preventing the incomplete connection of the pair of connector housing, in which the force of repulsion of the spring is made ineffective when the pair of connector housings are completely engaged with.

The foregoing object of the invention has been achieved by the provision of a connector which, according to the invention, comprises: a first connector housing which has a spring receiving member in such a manner that the spring receiving member is slidable back and forth, and a spring engaged with the spring receiving member; and a second connector housing which drives the spring receiving member against the spring when engaged with the first connector housing, and in which, when the first and second connector housings are completely connected together with locking mechanisms thereof engaged with each other, metal terminals provided in the first connector housing are engaged with those provided in the second connector housing, respectively, and the spring receiving member is locked to the first connector housing, to prevent the application of the force of repulsion of the spring to the second connector housing.

While the first and second connector housings are being engaged with each other, the force of repulsion of the spring acts against the engagement. However, when these housings have been completely engaged with each other, the force of repulsion is made ineffective.

DATAILED DESCRIPTION OF THE PREFERRED EMBODIMENTS

Figure 1:
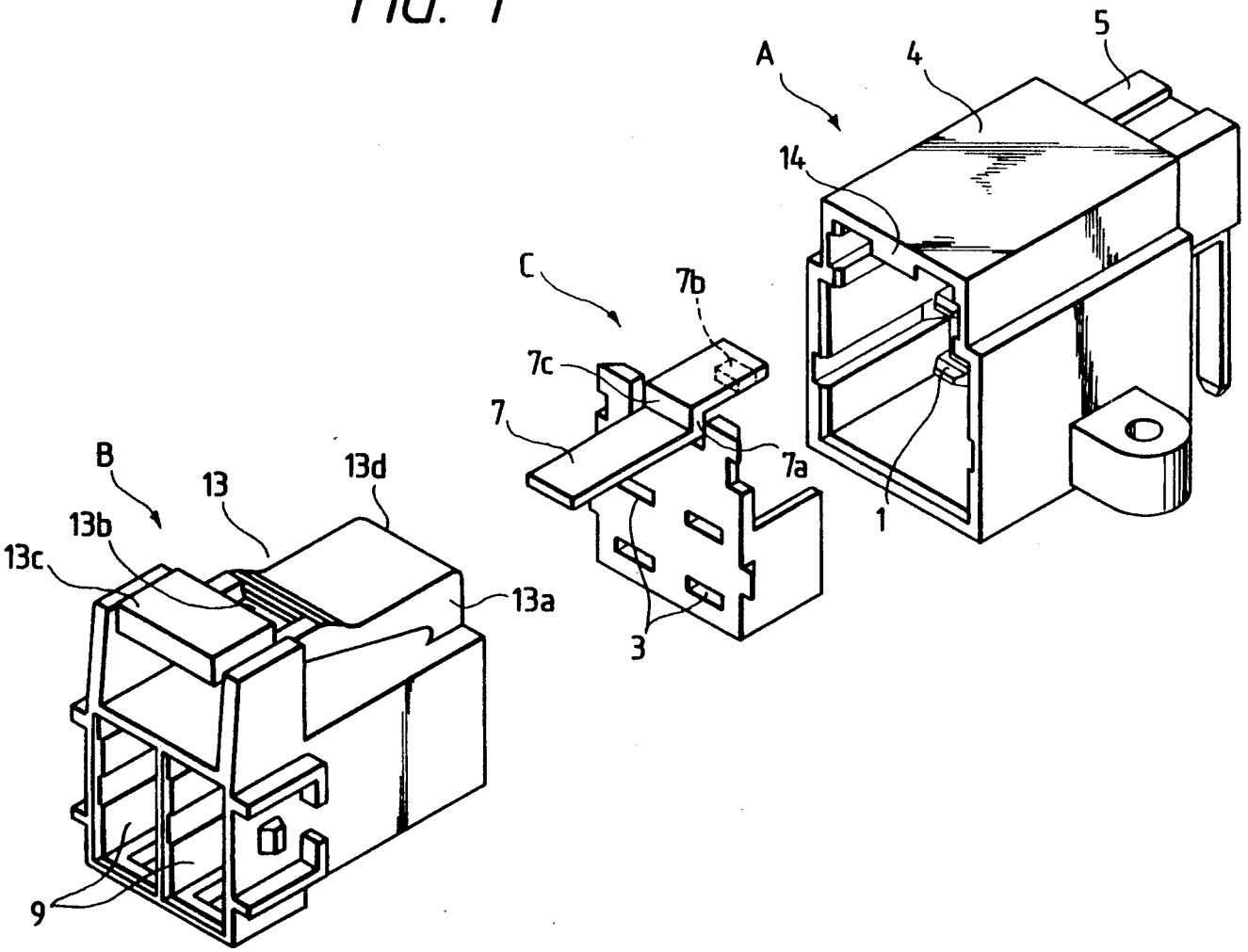
FIG. 1 an exploded perspective view showing an example of a connector according to this invention.

An example of a connector according to this invention is as shown in FIG. 1. In FIG. 1, reference character A designates a female connector housing; B, a male connector housing; and C, a spring receiving member built in the female connector housing A in such a manner that it is slidable back and forth.

A plurality of male metal terminals 1 are provided inside the female connector housing A in such a manner that they are fixedly held by the rear wall 2 and extended into the female connector housing body 4 through holes 3 formed in the spring receiving member C. The female connector housing 4 has a spring housing 5 which is extended backwardly to accommodate a compression coil 6 in such a manner that the front end of the latter 6 is abutted against the spring receiving member C.

A driven arm 7 is movably coupled through its middle portion **7*a* to the upper edge of the spring receiving member C. The driven arm 7 has a locking portion 7*b* at the rear end, which is engaged with a locking portion 8 of the spring housing 5**.

The male connector housing B has a terminal accommodating chamber 9, in which female metal terminals 11 connected to electrical wires 10 are locked with flexible locking pieces 12.

The male connector housing B has a flexible locking arm 13 in its upper region which has a rise base portion **13*a* at the front end. The flexible lock arm 13 further has a slot engaging portion 13*b* at the middle, and a depressing portion 13*c*** at the rear end.

Figure 2:
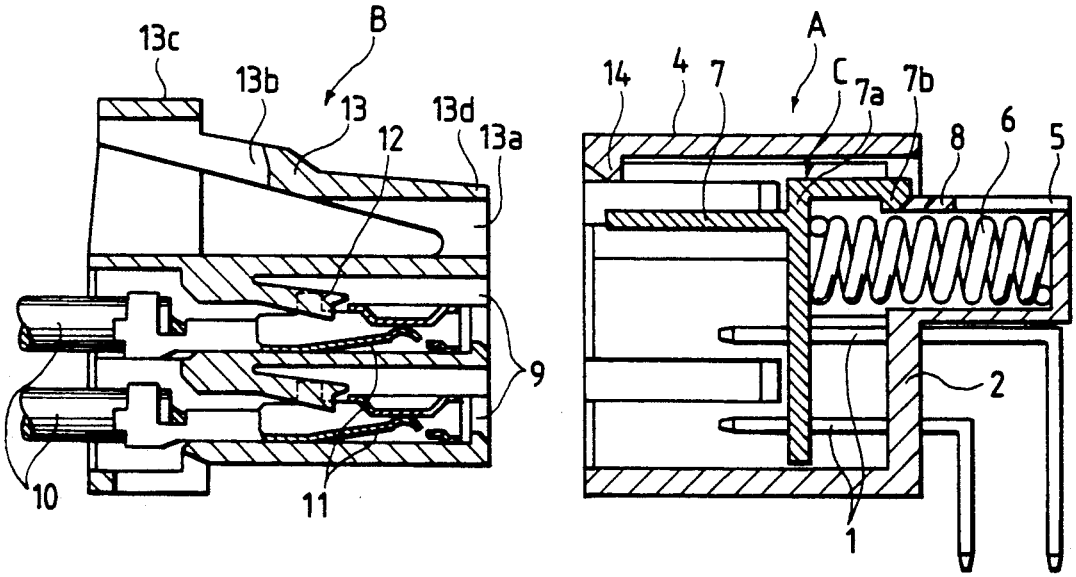
FIG. 2 is a sectional view showing a male connector housing and a female connector housing in the connector which are disengaged from each other.
Figure 3:
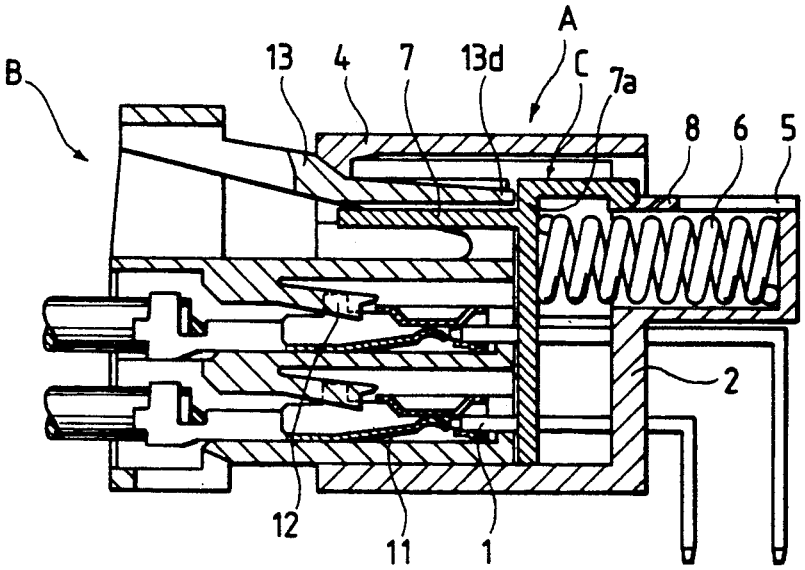
FIG. 3 is a sectional view showing the male and female connector housings which are being engaged with each other.

When the female and male connector housings A and B disconnected from each other as shown in FIG. 2 are moved towards each other, the driven arm 7 is caused to go into the flexible locking arm 13, while the front end potion **13*d* of the flexible locking arm 13 is abutted against the step 7*c* of the driven arm 7. As a result, the spring receiving member C is moved backwardly against the elastic force of the coil spring 6** (FIG. 3).

Figure 4:
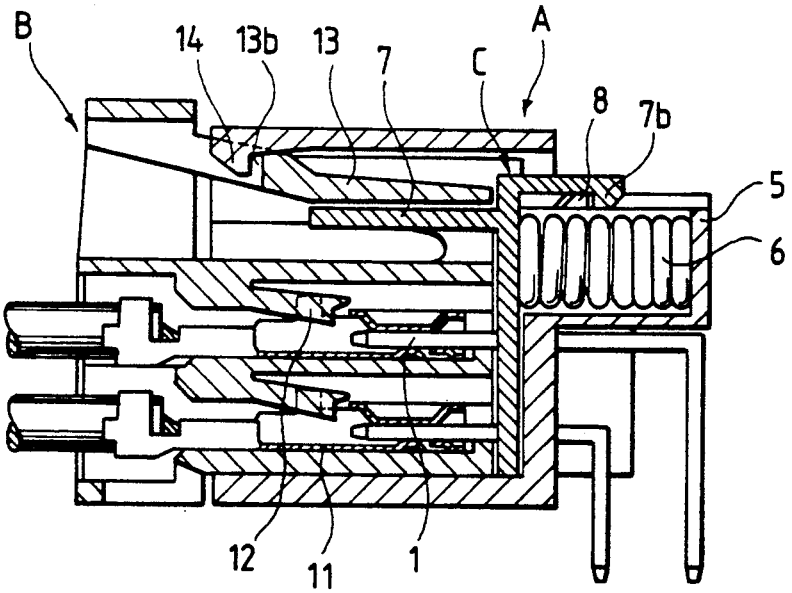
FIG. 4 is a sectional view showing the male and female connector housings which have been completely engaged with each other.

When the female and male connector housings A and B are further moved towards each other, the slot engaging portion **13*b* of the flexible locking arm 13 is engaged with a locking protrusion 14 which is extended inwardly from the front end of the female connector housing body 4, so that the male and female connector housings A and B are completely engaged and locked together. At the same time, the locking portion 7***b* of the driven arm 7 is engaged with the locking portion 8 of the spring housing 5, so that the spring receiving member C receives all the force of repulsion of the compression coil spring 6, thus protecting the male connector housing B from the force of repulsion of the coil spring 6 (FIG. 4).

Figure 5:
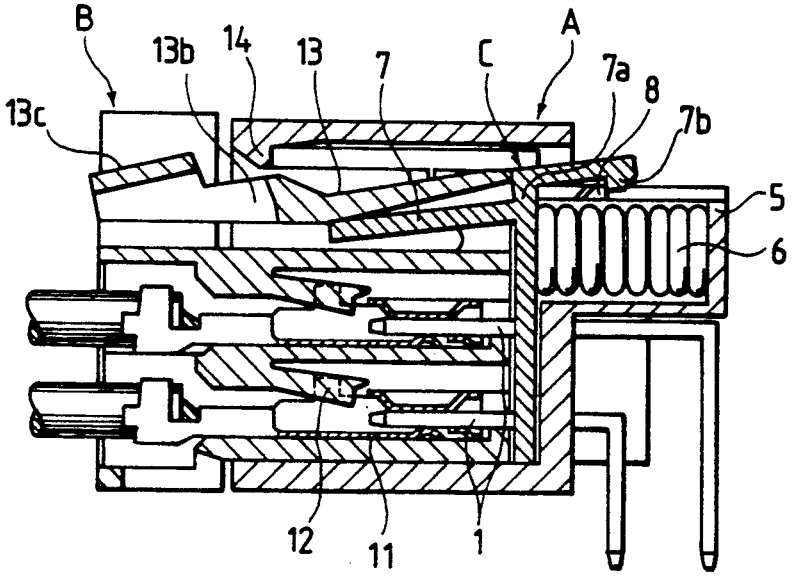
FIG. 5 is a sectional view showing the male and female connector housings which are unlocked.
Figure 6:
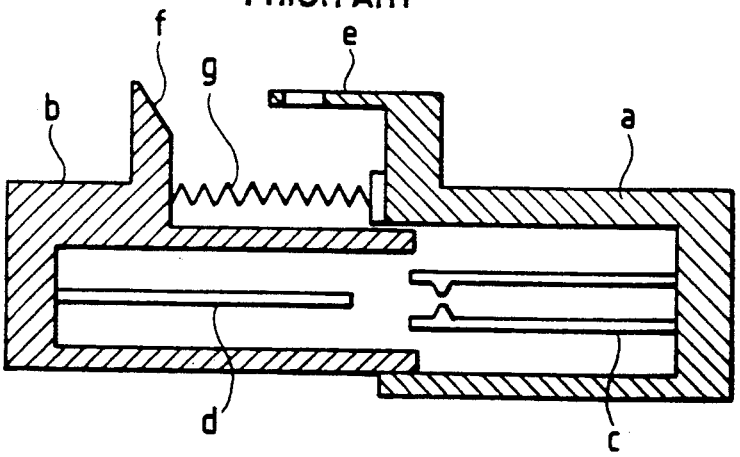
FIG. 6 PRIOR ART
FIG. 6 is a sectional view showing an example of a conventional connector.
Figure 7:
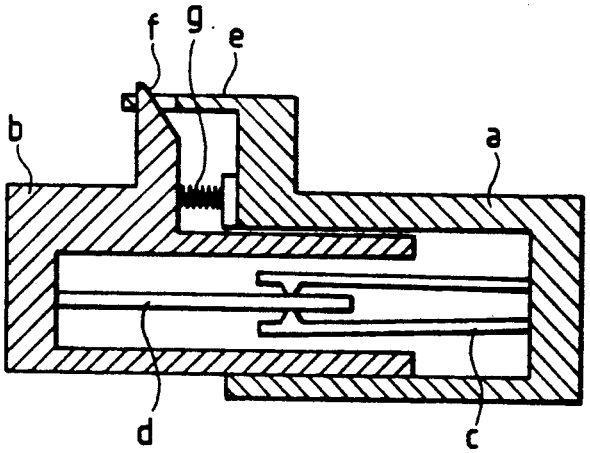
FIG. 7 PRIOR ART
FIG. 7 is a sectional view showing the conventional connector the male and female connector housings of which have been completely engaged with each other.

The male and female connector housings can be disengaged from each other as follows: The depressing portion 13*c* is pushed to disengage the slot engaging portion 13*b* from the engaging protrusion 14. In this operation, the driven arm 7 is pushed by the flexible locking arm 12, so that the locking portion 7*b* is disengaged from the locking portion 8 of the spring housing 5 to release the coil spring 6 thereby to disengage the male and female connector housings from each other (FIG. 5).

As was described above, the connector of the invention comprises: the first connector housing which has the spring receiving member in such a manner that the spring receiving member is slidable back and forth, and the spring engaged with the spring receiving member; and the second connector housing which drives the spring receiving member against the spring when engaged with the first connector housing. In the connector, when the first and second connector housings are completely connected together with the locking mechanisms thereof engaged with each other, the metal terminals provided in the first connector housing are engaged with those provided in the second connector housing, respectively, and the spring receiving member is locked to the first connector housing, to prevent the application of the force of the repulsion of the spring to the second connector housing. Hence, when the male and female connector housings have been completely engaged and locked together, the force of repulsion of the spring adapted to prevent the incomplete engagement of the male and female connector housings is not effected between the male and female connector housings. Therefore, the metal terminals provided in the male connector housing are maintained stably engaged with those provided in the female connector housing.

What is claimed is:

1. A connector comprising:

a first connector housing having first metal terminals;

a second connector housing having second metal terminals engaged with said first metal terminals; and a lock for locking said first connector housing to said second connector housing, said lock including:

spring receiving means, slidably disposed in said first connector housing, for receiving a repulsive force acting between said first and second connector housings through said spring receiving means, said spring receiving means being adapted to be locked in a predetermined position in said first connector housing; and a spring, for applying said repulsive force to said first and second connector housings through said spring receiving means, disposed between said first connector housing and said spring receiving means, wherein when said first and second connector housings are locked to one another, said spring receiving means is locked in said predetermined position in said first connector housing, and wherein said lock includes means for simultaneously unlocking said first connector housing from said second connector housing and said spring receiving means from said first connector housing.

2. A connector as claimed in claim 1, wherein when said first and second connector housings are locked, said spring receiving means receives said repulsive force to avoid applying said repulsive force to said second connector housing.

3. A connector as claimed in claim 1, wherein said spring applies a releasing force to said first connector housing and said spring receiving means when said lock is disconnected.

4. A connector as claimed in claim 1, wherein said spring applies said repulsive force to said first and second connector housings through said spring receiving means, to avoid incomplete connection of said first and second connector housings.

5. A connector, comprising:

a first connector housing having first metal terminals;

a second connector housing having second metal terminals engaged with said first metal terminals; and locking means for engaging said first connector housing with said second connector housing, said lock means including:

a spring receiving means, slidably disposed in said first connector housing, for receiving a repulsive force acting between said first and second connector housings through said spring receiving means; and a spring for applying said repulsive force to said first and second connector housings through said spring receiving means, and being disposed between said first connector housing and said spring receiving means, wherein said lock means includes a driven arm provided with said spring receiving means and a flexible locking arm provided with said second connector housing, and said driven arm is driven by said flexible locking arm to disengage said spring receiving means from said first connector housing.

* * * * *